US008240833B2

(12) United States Patent
Owaki et al.

(10) Patent No.: US 8,240,833 B2
(45) Date of Patent: Aug. 14, 2012

(54) LIQUID EJECTING HEAD, METHOD OF MANUFACTURING THE SAME, AND LIQUID EJECTING APPARATUS

(75) Inventors: Hiroshige Owaki, Okaya (JP); Hiroyuki Kamikura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 466 days.

(21) Appl. No.: 12/389,493

(22) Filed: Feb. 20, 2009

(65) Prior Publication Data

US 2009/0213199 A1 Aug. 27, 2009

(30) Foreign Application Priority Data

Feb. 21, 2008 (JP) ..... 2008-040628

(51) Int. Cl.
*B41J 2/175* (2006.01)

(52) U.S. Cl. ..... 347/93; 347/85

(58) Field of Classification Search ..... None
See application file for complete search history.

(56) References Cited

U.S. PATENT DOCUMENTS

| | | | | |
|---|---|---|---|---|
| 4,928,870 | A | 5/1990 | Gat-Liquornik | |
| 5,464,578 | A | 11/1995 | Salter | |
| 5,688,460 | A * | 11/1997 | Ruschke | 264/263 |
| 5,699,095 | A * | 12/1997 | Mitsuzawa et al. | 347/92 |
| 5,938,991 | A | 8/1999 | Pollock | |
| 6,019,465 | A * | 2/2000 | Shinada et al. | 347/93 |
| 6,033,610 | A | 3/2000 | Swanson | |
| 6,086,195 | A * | 7/2000 | Bohorquez et al. | 347/93 |
| 6,190,009 | B1 | 2/2001 | Kitahara | |
| 6,196,673 | B1 * | 3/2001 | Takahashi | 347/93 |
| 6,415,121 | B1 * | 7/2002 | Suzuki et al. | 399/111 |
| 6,457,821 | B1 | 10/2002 | Liu | |
| 6,634,742 | B2 | 10/2003 | Owaki | |
| 6,729,717 | B2 | 5/2004 | Ito | |
| 6,814,435 | B1 * | 11/2004 | Shimada et al. | 347/93 |
| 6,958,183 | B2 | 10/2005 | Okamura | |
| 7,029,617 | B2 | 4/2006 | Nishimuro | |
| 7,063,405 | B2 | 6/2006 | Ito | |
| 7,153,459 | B2 | 12/2006 | Kitahara | |

(Continued)

FOREIGN PATENT DOCUMENTS

JP 59-135110 U 9/1984

(Continued)

OTHER PUBLICATIONS

U.S. Appl. No. 12/263,092, Jun. 7, 2011, Office Action.

(Continued)

*Primary Examiner* — Stephen Meier
*Assistant Examiner* — Leonard S Liang
(74) *Attorney, Agent, or Firm* — Workman Nydeger

(57) ABSTRACT

A liquid ejecting head includes: a first supply member and a second supply member, each of which has a liquid supply passage formed therein; a filter that is held between the first supply member and the second supply member in correspondence with the liquid supply passage; a thermally welded portion that is welded to the filter so that the first supply member melts and soaks into the filter in a region that surrounds the liquid supply passage; a bonded portion at which the second supply member is bonded to the filter by the thermally welded portion; and a bonding resin that is formed by being poured into an outer region between the first supply member and the second supply member and outside the thermally welded portion and bonded portion with respect to the liquid supply passage.

6 Claims, 12 Drawing Sheets

U.S. PATENT DOCUMENTS

| | | | | |
|---|---|---|---|---|
| 7,775,652 | B2 | 8/2010 | Taira et al. | |
| 7,862,759 | B2 | 1/2011 | Kamikura | |
| 7,878,638 | B2 * | 2/2011 | Akase et al. | 347/92 |
| 7,922,311 | B2 * | 4/2011 | Chikamoto et al. | 347/93 |
| 2003/0197767 | A1 * | 10/2003 | Dudenhoefer et al. | 347/93 |
| 2004/0179057 | A1 * | 9/2004 | Yamada | 347/20 |
| 2004/0183229 | A1 | 9/2004 | Kunzel | |
| 2004/0257414 | A1 | 12/2004 | Anderson | |
| 2006/0001718 | A1 * | 1/2006 | Shimizu | 347/93 |
| 2009/0122125 | A1 | 5/2009 | Owaki | |
| 2009/0207222 | A1 | 8/2009 | Kamikura | |
| 2009/0225142 | A1 | 9/2009 | Kamikura | |
| 2010/0071211 | A1 | 3/2010 | Kobayashi | |

FOREIGN PATENT DOCUMENTS

| | | | |
|---|---|---|---|
| JP | 02-038377 | A | 2/1990 |
| JP | 11-277758 | A | 10/1999 |
| JP | 2000-141683 | A | 5/2000 |
| JP | 2000-158667 | A | 6/2000 |
| JP | 2000-211130 | | 8/2000 |
| JP | 2001-030297 | A | 2/2001 |
| JP | 2002-067312 | A | 3/2002 |
| JP | 2002-067342 | | 3/2002 |
| JP | 2003-201114 | | 7/2003 |
| JP | 2007-069434 | A | 3/2007 |
| JP | 2007-136737 | A | 6/2007 |
| JP | 2007-136871 | | 6/2007 |
| JP | 2007-160821 | A | 6/2007 |
| JP | 2007-160863 | A | 6/2007 |
| JP | 2007245464 | A * | 9/2007 |
| JP | 2007-283668 | A | 11/2007 |
| JP | 2008018625 | A * | 1/2008 |

OTHER PUBLICATIONS

U.S. Appl. No. 12/398,349, Sep. 2, 2011, Office Action.
U.S. Appl. No. 12/389,507, Jun. 2, 2010, Office Action.
U.S. Appl. No. 12/389,507, Nov. 4, 2010, Notice of Allowance.
U.S. Appl. No. 12/561,932, Mar. 16, 2011, Notice of Allowance.

* cited by examiner

LIQUID EJECTING HEAD, METHOD OF MANUFACTURING THE SAME, AND LIQUID EJECTING APPARATUS

BACKGROUND

1. Technical Field

The invention relates to a liquid ejecting head, a method of manufacturing the same, and a liquid ejecting apparatus provided with the liquid ejecting head and, more particularly, to an ink jet recording head that discharges ink as liquid, a method of manufacturing the same, and an ink jet recording apparatus.

2. Related Art

In an ink jet recording head, which is a typical liquid ejecting head, generally, ink is supplied from an ink cartridge, which is a liquid reservoir portion and filled with ink, to a head element through an ink flow passage, which is formed in a supply member, such as an ink supply needle, which is an ink supply element and detachably inserted into the ink cartridge, and a cartridge case in which the ink cartridge is held, and the ink supplied to the head element is discharged from a nozzle by driving a pressure generating device, such as a piezoelectric element, provided for the head element.

In the above ink jet recording head, when bubbles that are present in ink contained in the ink cartridge or bubbles trapped into ink when the ink cartridge is attached or detached are supplied to the head element, the bubbles problematically cause defective discharge, such as dot omission. To solve the above problem, there is a technique that a filter is provided between an ink supply needle, inserted into an ink cartridge, and a supply member to remove bubbles, dust, or the like, in the ink (see JP-2000-211130, for example).

In addition, the above filter is fixed to the supply member by means of thermal welding, or the like, and the ink supply needle is fixed to the supply member by means of ultrasonic welding, or the like.

However, with the configuration described in JP-2000-211130, the filter is provided in a region to which the ink supply needle of the supply member is fixed. This requires a region corresponding to the area of the filter and also requires a region for separately welding the ink supply needle and the filter to the supply member. Thus, an interval between the adjacent ink supply needles cannot be reduced and, therefore, the size of a head problematically increases.

In addition, in the configuration described in JP-A-2000-211130, when the area of the filter is excessively reduced for reducing the size of the head, a dynamic pressure increases. This problematically requires an increase in driving voltage for driving a pressure generating device, such as a piezoelectric element or a heater element.

In addition, when the ink supply needle is fixed to the supply member by means of thermal welding, a gap may be formed therebetween. Thus, ink problematically leaks through the gap.

Note that the above problems are not only present in the ink jet recording head but also similarly present in a liquid ejecting head that ejects liquid other than ink.

SUMMARY

An advantage of some aspects of the invention is that it provides a liquid ejecting head that is able to prevent leakage of liquid, a method of manufacturing the liquid ejecting head, and a liquid ejecting apparatus.

An aspect of the invention provides a liquid ejecting head. The liquid ejecting head has a nozzle opening for ejecting liquid supplied from a liquid reservoir unit, which stores the liquid, through a liquid supply passage. The liquid ejecting head includes: a first supply member and a second supply member, each of which has the liquid supply passage formed therein; a filter that is held between the first supply member and the second supply member in correspondence with the liquid supply passage; a thermally welded portion that is welded to the filter so that the first supply member melts and soaks into the filter in a region that surrounds the liquid supply passage; a bonded portion at which the second supply member is bonded to the filter by the thermally welded portion; and a bonding resin that is formed by being poured into an outer region between the first supply member and the second supply member and outside the thermally welded portion and bonded portion with respect to the liquid supply passage. According to the above aspect, the thermally welded portion, the bonded portion and the bonding resin fix and integrate the first supply member, the filter and the second supply member. Thus, it is possible to isolate the liquid supply passage without reducing the effective area of the filter. In addition, even when a filter that extends over a plurality of flow passages is used, liquid that flows through each of the plurality of flow passages is not mixed with each other through the filter, so the size of the head may be reduced. In addition, it is not necessary to reduce the effective area of the filter for reducing the size of the head. This prevents an increase in dynamic pressure and, therefore, it is not necessary to increase a driving voltage at which a pressure generating device, such as a piezoelectric element or a heater element, is driven. Furthermore, the area of the peripheral portion of the filter is minimized and then the outer peripheral end surfaces of the filter are covered with the outer portion. In addition, the thermally welded portion reliably prevents a gap from being formed between a supply element and a filter fitting member, so it is possible to reliably prevent leakage of liquid through a gap.

Here, the bonding resin may be formed in a region outside the bonded portion and facing the thermally welded portion. With this configuration, it is possible to fix and integrate the first supply member, the filter and the second supply member in a state where the adjacent liquid flow passages are further reliably isolated from each other.

In addition, the thermally welded portion may be present all around a region of the filter, which surrounds the liquid supply passage, an outer portion may be further provided continuously to the bonding resin in the outer region all around the first supply member and the second supply member, and the first supply member and the second supply member may additionally be bonded by the outer portion. With this configuration, integration of the first supply member with the second supply member is further enhanced by the outer portion. Thus, it is possible to further reliably prevent leakage between the adjacent liquid supply passages.

In addition, the thermally welded portion, the bonded portion and the bonding resin may be integrated, and the first supply member and the second supply member may be bonded through the integrated thermally welded portion, bonded portion and bonding resin. With this configuration, the filter around the liquid supply passage is further reliably sealed by the resin formed of the integrated thermally welded portion, bonded portion and bonding resin. Thus, the filter is further reliably fixed.

In addition, the thermally welded portion may form a wall surface of the liquid supply passage. With this configuration, the liquid supply passage is further reliably sealed by the thermally welded portion.

Furthermore, another aspect of the invention provides a liquid ejecting apparatus that includes the liquid ejecting head according to the above aspect. With this configuration, it is possible to implement a small, low-cost liquid ejecting apparatus.

Further another aspect of the invention provides a method of manufacturing a liquid ejecting head having a nozzle opening for ejecting liquid supplied from a liquid reservoir unit, which stores the liquid, through a liquid supply passage formed at least in a first supply member and a second supply member. The method includes: thermally welding a filter with the first supply member through a thermally welded portion by melting a thermally welded region of the first supply member, which is provided around the liquid supply passage; arranging the second supply member so as to face and contact the thermally welded portion of the first supply member to which the filter is welded; and bonding the first supply member with the arranged second supply member. According to the above aspect, the second supply member is fixedly bonded and integrated with the filter through the thermally welded portion that integrates the first supply member with the filter. Thus, it is possible to achieve the integration in a state where the filters are completely isolated without reducing the effective area and, therefore, the size of the head may be reduced. In addition, it is not necessary to reduce the effective area of the filter for reducing the size of the head. This prevents an increase in dynamic pressure and, therefore, it is not necessary to increase a driving voltage at which a pressure generating device, such as a piezoelectric element or a heater element, is driven. Furthermore, the area of the peripheral portion of the filter is minimized and then the outer peripheral end surfaces of the filter are covered with the thermally welded portion. In addition, the thermally welded portion reliably prevents a gap from being formed between a supply element and a filter fitting member, so it is possible to reliably prevent leakage of liquid through a gap.

Here, the first supply member may be bonded to the second supply member in such a manner that molten resin is poured near the thermally welded portion and then the thermally welded portion is melted by heat of the molten resin. With this configuration, in the process of forming the bonding resin by pouring molten resin near the thermally welded portion, the first supply member, the filter and the second supply member are reliably integrated through the thermally welded portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described in detail with reference to the accompanying drawings.

First Embodiment

Figure 1:
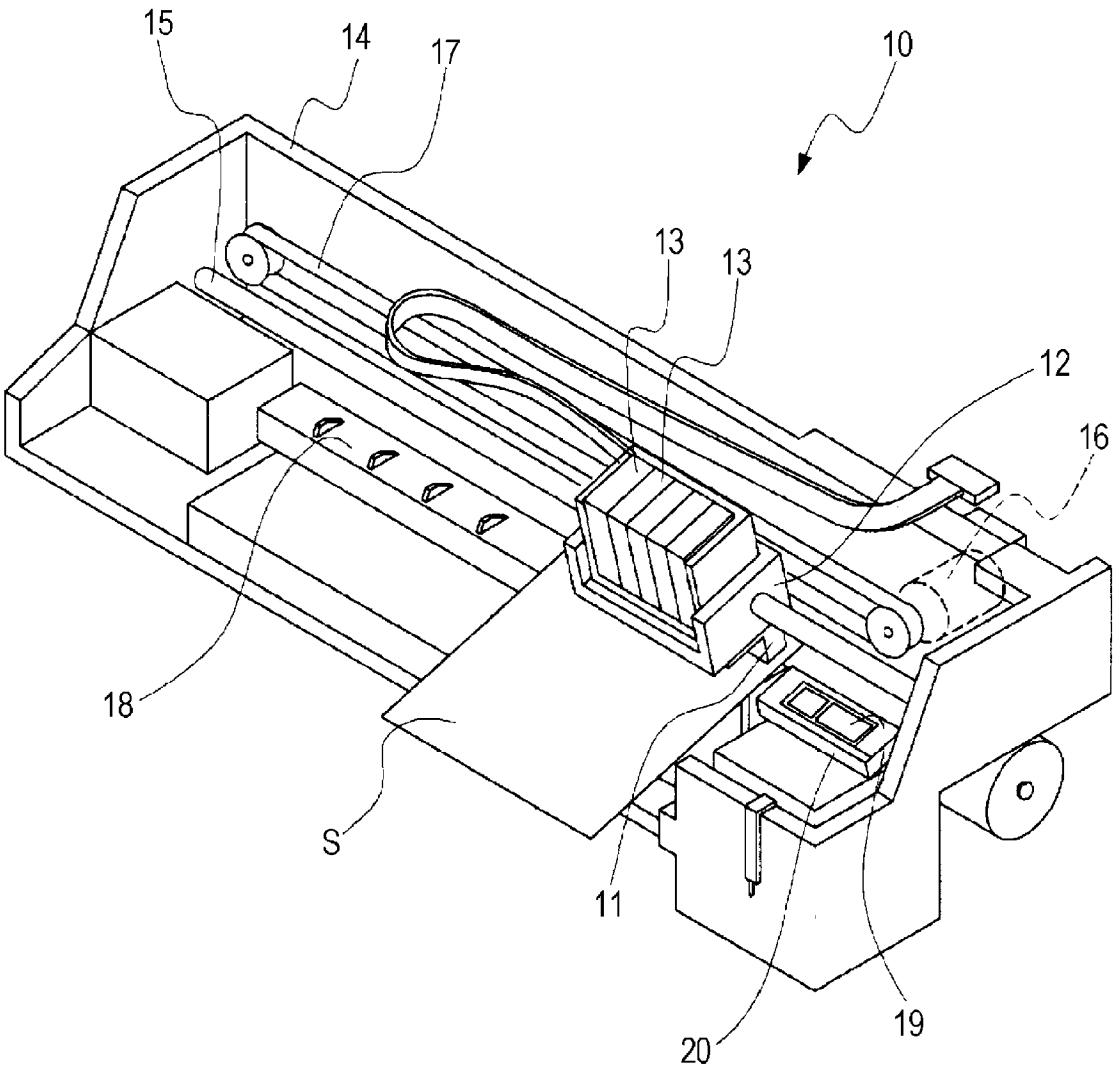
FIG. 1 is a schematic perspective view of a recording apparatus according to a first embodiment of the invention.

FIG. 1 is a schematic perspective view of an ink jet recording apparatus, which is an example of a liquid ejecting apparatus, according to a first embodiment of the invention. As shown in FIG. 1, the ink jet recording apparatus 10 according to the present embodiment is formed so that an ink jet recording head 11 (hereinafter, also referred to as recording head), which is an example of a liquid ejecting head that discharges ink droplets, is fixed to a carriage 12, ink cartridges 13, which are liquid reservoir portions, are detachably fixed to the recording head 11, and a plurality of different color inks, such as black (B), light black (LB), cyan (C), magenta (M), yellow (Y), and the like, are stored in the ink cartridges 13.

The carriage 12, on which the recording head 11 is mounted, is axially movably provided on a carriage shaft 15 connected to an apparatus body 14. Then, driving force of a drive motor 16 is transmitted to the carriage 12 through a plurality of gears (not shown) and a timing belt 17 to thereby move the carriage 12 along the carriage shaft 15. On the other hand, a platen 18 is provided for the apparatus body 14 along the carriage shaft 15, and a recorded target medium S, such as a sheet of paper, that is fed by a paper feed device (not shown), or the like, is transported on the platen 18.

A capping device 20 having a cap member 19 that seals a nozzle forming surface of the recording head 11 is provided at a position corresponding to a home position of the carriage 12, that is, near one end of the carriage shaft 15. The cap member 19 seals the nozzle forming surface, on which nozzle openings are formed, to prevent drying of ink. In addition, the cap member 19 also operates as an ink receiver during flushing operation.

Here, the recording head 11 according to the present embodiment will be described. Note that FIG. 2 is an exploded perspective view of the ink jet recording head, which is an example of a liquid ejecting head, according to the present embodiment.

Figure 2:
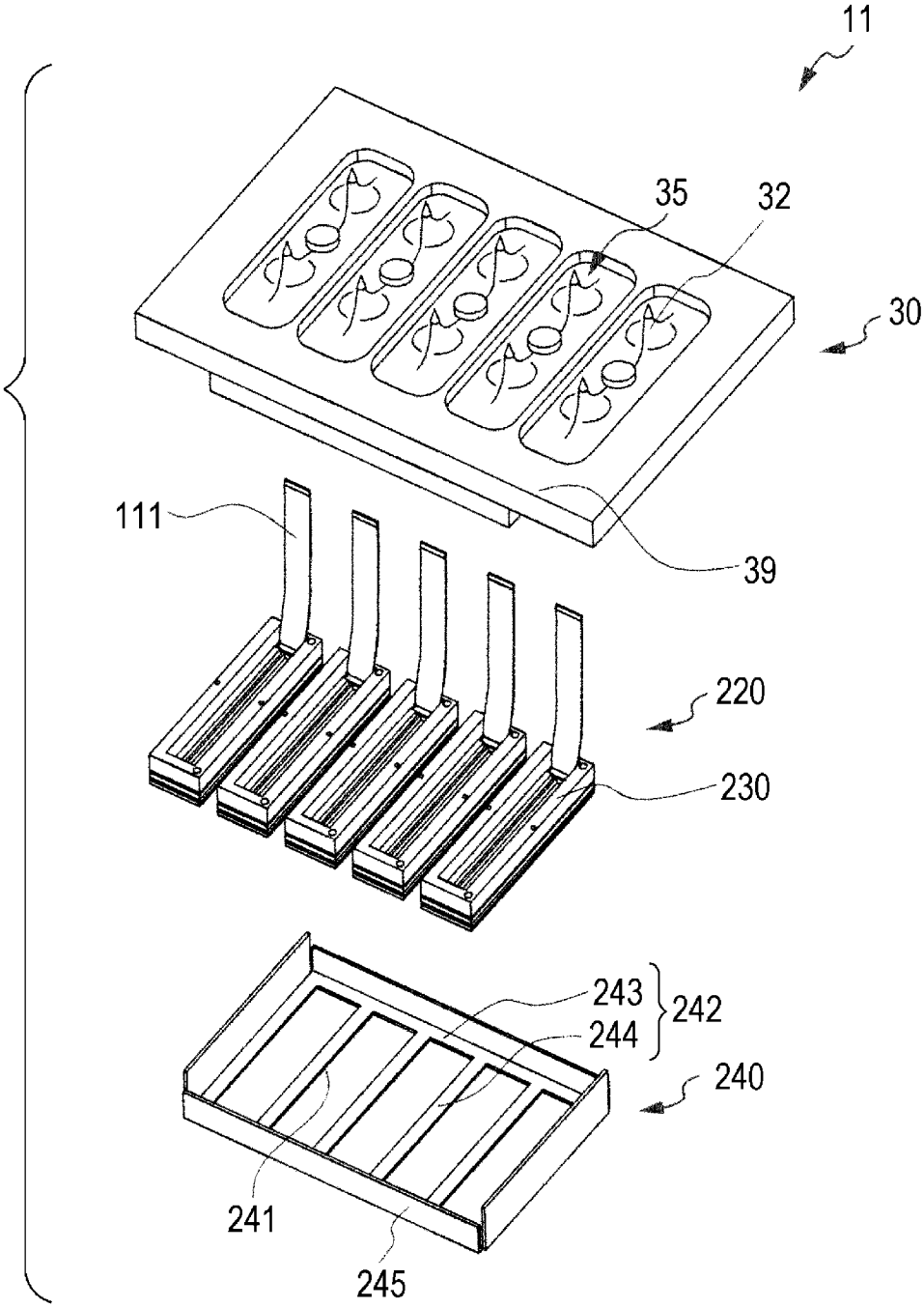
FIG. 2 is an exploded perspective view of a recording head according to the first embodiment of the invention.

As shown in FIG. 2, the recording head 11 includes a supply member 30 such as a cartridge case, a head element 220, and a cover head 240. The ink cartridges 13, which are liquid reservoir portions, are fixed to the supply member 30. The head element 220 is fixed to a surface of the supply member 30, which is opposite to a side on which the ink cartridges 13 are fixed. The cover head 240 is provided on a liquid ejecting surface side of the head element 220.

Figure 3:
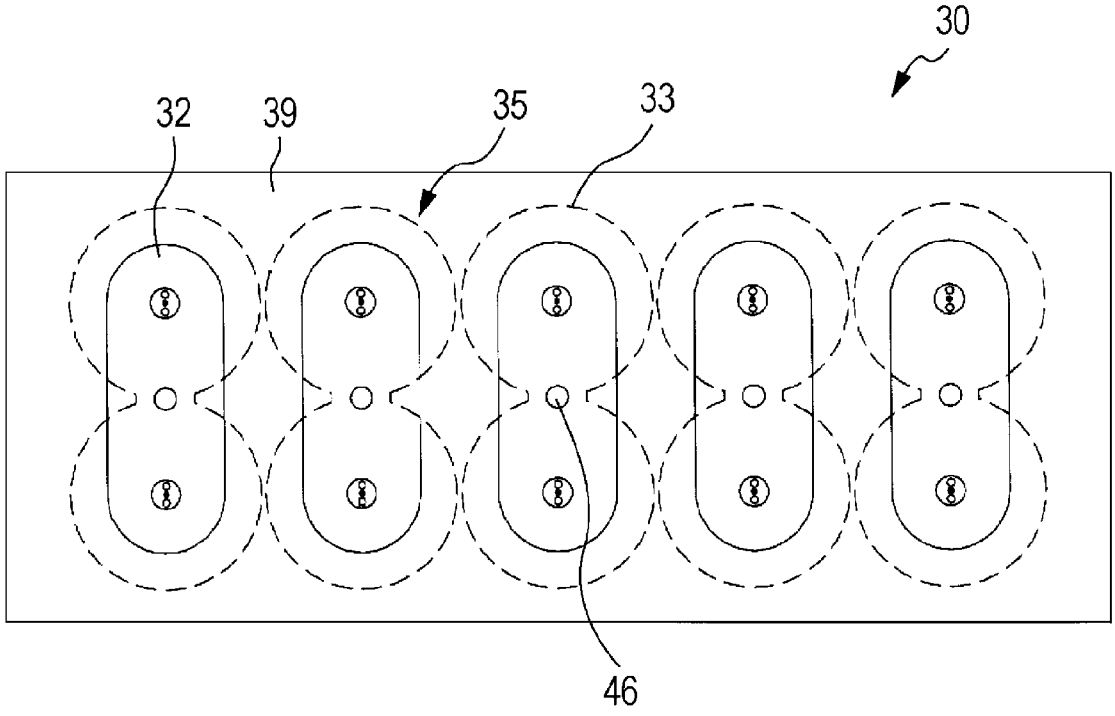
FIG. 3 is a top view of a supply member according to the first embodiment of the invention.
Figure 4:
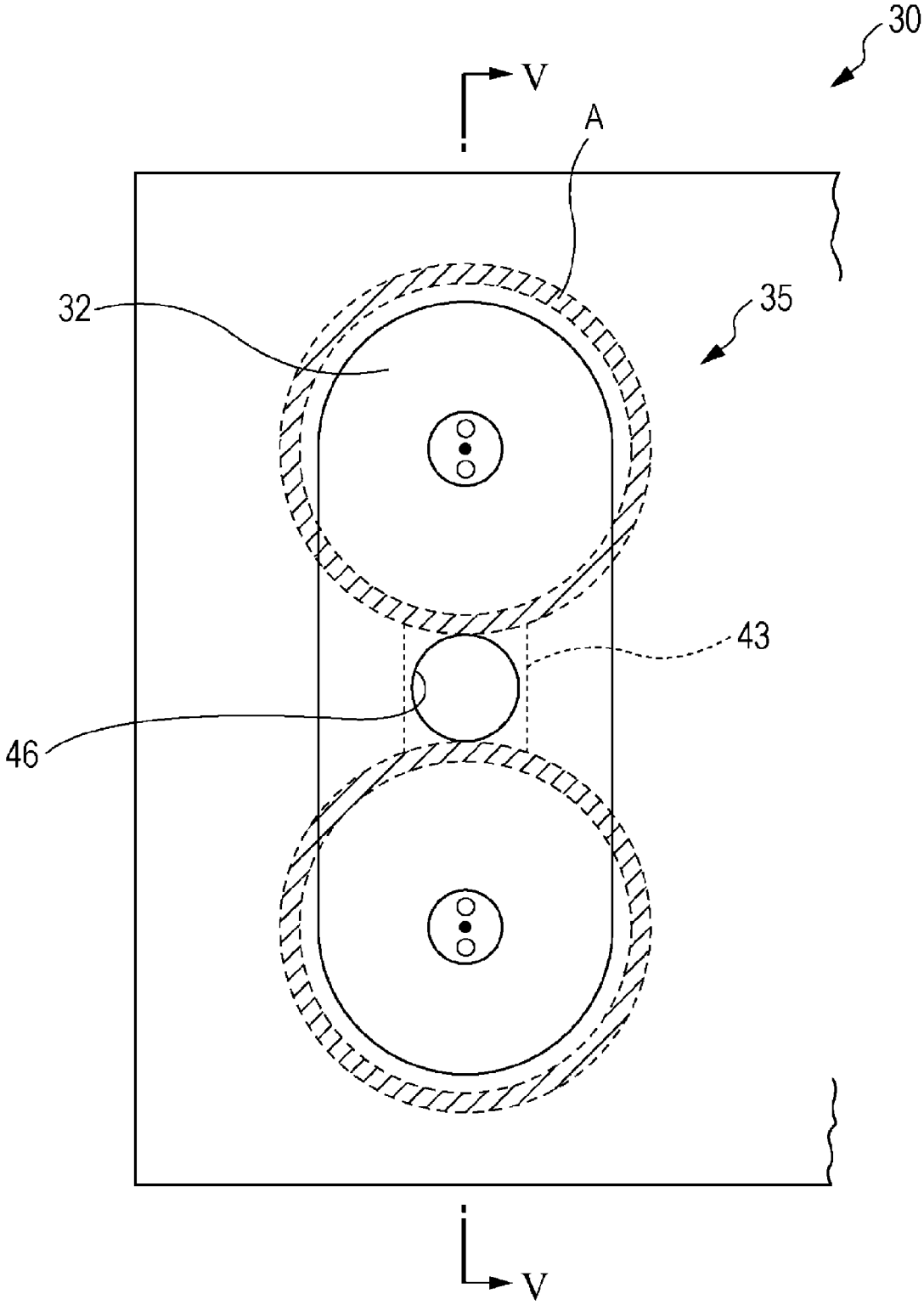
FIG. 4 is an enlarged top view of a relevant portion of the supply member according to the first embodiment of the invention.

First, the supply member 30 will be described in detail. Note that FIG. 3 is a top view of the supply member, FIG. 4 is an enlarged top view of a relevant portion of the supply member, and FIG. 5 is a cross-sectional view that is taken along the line V-V in FIG. 4.

Figure 5:
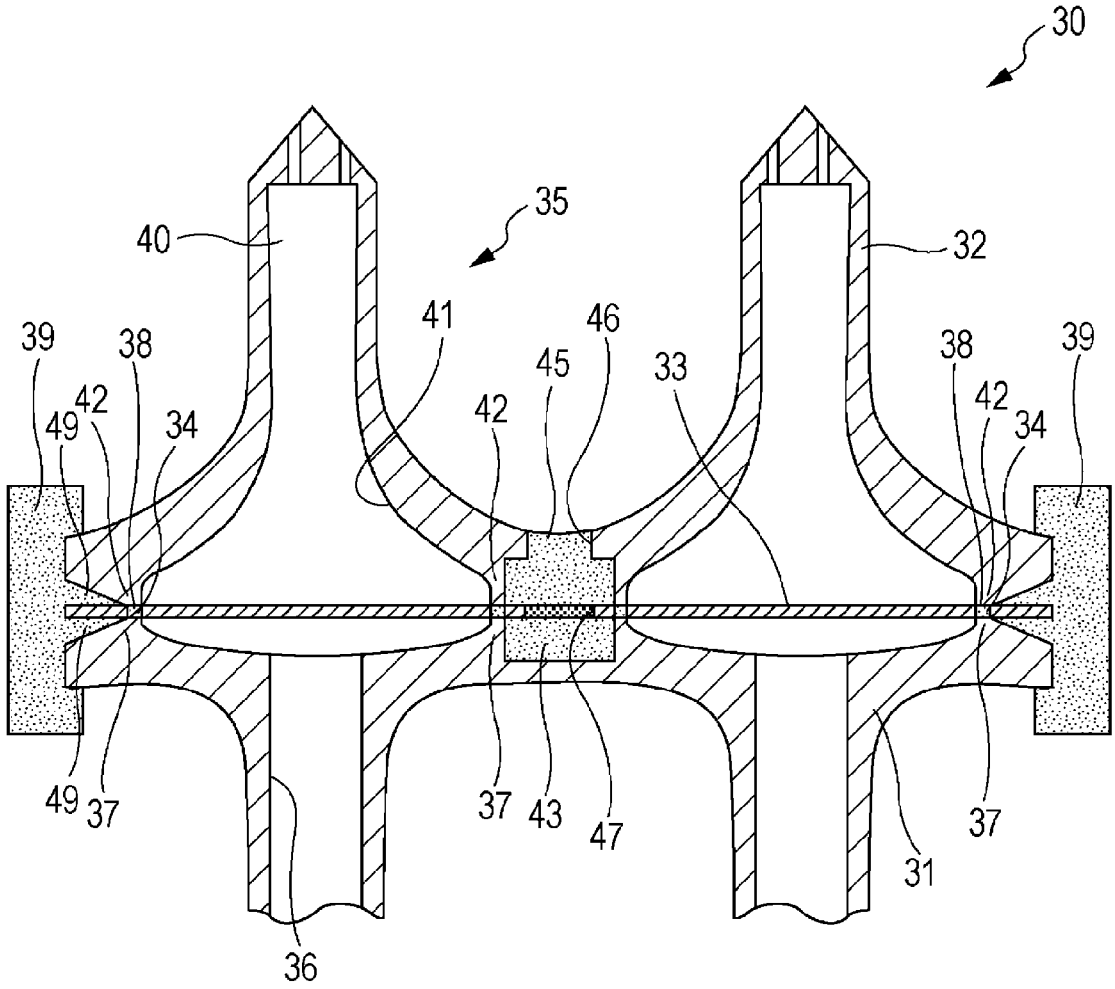
FIG. 5 is a cross-sectional view of the supply member according to the first embodiment of the invention.

As shown in FIG. 5, the supply member 30 is formed so that a filter is held between a first supply member and a second supply member. In the present embodiment, a supply member element 31 is located at the downstream side of a flow passage and corresponds to any one of the first supply member and the second supply member. Supply needles 32 are provided at the upstream side of the flow passage with respect to the supply member element 31 and correspond to the other one of the first supply member and the second supply member. A filter 33 is provided between the supply member element 31 and the supply needles 32. Then, the supply member element 31, the supply needles 32 and the filter 33 are integrated together by thermally welded portions 34 and outer portion 39.

The supply member 30 has supply element forming portions 35. The above described ink cartridges 13 (which correspond to "liquid reservoir portions") are attached to one end surface of the supply element forming portions 35. Of course, it is applicable that the ink cartridges 13 are not directly attached to the supply element forming portions 35 but ink, which is liquid, is introduced from liquid reservoir portions through tubes to the supply element forming portions 35 instead.

In addition, liquid supply passages 36 are formed in the supply member element 31 on the downstream side of the filter 33, which will be described later. One end of each liquid supply passage 36 is open to a corresponding one of the supply element forming portions 35, and the other end is open to the head element 220 side to thereby supply ink from the ink cartridges 13 to the head element 220. Note that the plurality of liquid supply passages 36 are provided so as to be arranged in the longitudinal direction of the supply member element 31, and the liquid supply passages 36 are independently provided for the respective ink cartridges 13 provided in one-to-one correspondence with the ink colors.

In addition, a filter holding portion 37, which is a region around each of the openings of the liquid supply passages 36 on the surface of the supply member element 31 (supply element forming portion 35) is integrally fixed to the thermally welded portion 34, and the filter 33 is integrally fixed between the filter holding portions 37 and the filter holding portions 42 of the supply needles 32. Here, the region around each liquid supply passage 36 is a peripheral portion adjacent to the opening of the liquid supply passage 36 and a filter chamber 41, and in the present embodiment, a wall surface around each liquid supply passage 36 is defined by the thermally welded portion 34. Then, in terms of space saving, it is desirable that the thermally welded portions 34 are located adjacent to the openings as much as possible.

The supply needles 32, which are supply elements, are fixed to the surface of the supply member element 31 (supply element forming portion 35), and each have a through passage 40 that communicates with the corresponding liquid supply passage 36. The filter chamber 41 is provided in a region in which each through passage 40 is connected to the corresponding liquid supply passage 36. Each filter chamber 41 is a space having a larger inner diameter than the other region, that is, a wide portion. In the present embodiment, each filter chamber 41 is, for example, formed so that the inner diameter increases toward the supply member element 31. The openings at the filter 33 sides of the filter chambers 41 are liquid supply ports, and ink supplied from the ink cartridges 13 is supplied through the liquid supply ports to the supply member element 31.

Each supply needle 32 has the filter holding portion 42 in a region of the bottom surface, adjacent to the supply member element 31, which surrounds the filter chamber 41, in correspondence with the holding portion 37 of the supply member element 31 to hold the filter 33 between the filter holding portion 37 and the filter holding portion 42.

Each filter 33 is, for example, formed of a finely braided sheet-like metal, and is held between the supply member element 31 and the supply needles 32. In addition, in the present embodiment, the shape of each filter 33 is not specifically limited, and it is only necessary to have a shape such that the thermally welded portions 34 may be ensured. FIG. 4 shows the thermally welded portion 34, as indicated by the region A, that is formed so that molten resin soaks into the filter 33. The filter 33 has a shape such that portions that seal the liquid supply passages 36 are connected by connecting portions 43, and has through-holes 47 in the connecting portions 43.

Here, the supply member element 31 and the filters 33 are initially integrated in a state where regions corresponding to the individual liquid supply passages 36 are isolated by the thermally welded portions 34, and the supply member element 31 and the filters 33, which are integrated by the thermally welded portions 34, and the supply needles 32 are set in a die, and then injection molding is performed using resin. Thus, molten resin is poured near the regions outside the thermally welded portions 34 with respect to the liquid supply passages 36. At least surfaces of the thermally welded portions 34 melt by the heat of molten resin, and then the filters 33 and the supply needles 32 are bonded through bonded portions 38. That is, portions of the supply member element 31 outside the filter holding portions 37 and portions of the supply needles 32 outside the filter holding portions 42 are respectively formed so as to be lower in level from the filter holding portions 37 and 42, and resin for forming the outer portion 39 fills gaps between the filter holding portions 37 and 42 and the filters 33, and then the bonded portions 38 are formed by the heat of the resin. In addition, at the same time, the filled molten resin that surrounds the thermally welded portions 34 and the bonded portions 38 forms the outer portion 39. Here, the outer portion 39 is formed continuously to outer regions that surroundingly contact portions outside the thermally welded portions 34 and bonded portions 38, and the portions that fill the outer regions constitute bonding resins 49. The bonding resin 49 formed in each of the outer regions is integrated with the thermally welded portion 34 and the bonded portion 38. These thermally welded portions 34, bonded portions 38 and bonding resins 49 reliably seal the through passages 40 and the liquid supply passages 36 independently of one another. In addition, the supply member element 31, the supply needles 32 and the filters 33 are integrated, so that it is possible to prevent mixing of ink caused by ink leakage from the adjacent liquid supply passage 36.

In addition, the outer portion 39 of the present embodiment is formed so as to surround the outer peripheries of the supply member element 31 and supply needles 32. Thus, the supply member element 31, the supply needles 32 and the filters 33 are further reliably integrated.

Here, in the present embodiment, two supply needles 32 are integrated to form a single member that integrates the two supply needles 32 for two liquid supply passages. That is, in the present embodiment, as shown in FIG. 3, five members are provided for ten liquid supply passages 36 (not shown). Then, in a region between the two supply needles 32, a communication portion 45 that communicates with the outer portion 39 on each side and that surrounds the connecting portion 43 of the filter 33, and a charging hole 46 that communicates with a gate for introducing resin for forming the outer portion 39 that is formed in the communication portion 45.

The filter 33 may be provided in units of a liquid supply passage 36 or one continuous filter 33 may be provided in units of a plurality of the liquid supply passages 36. In the present embodiment, one filter 33 is provided continuously between the two liquid supply passages 36. Thus, the through-hole 47 is formed in the connecting portion 43 of the filter 33 in a region corresponding to the above described charging hole 46 so that resin introduced from the charging hole 46 is reliably charged to the outer portion 39. Of course, the through-hole 47 need not be provided, and the filters 33 corresponding to the ten liquid supply passages 36 may be connected and used as one filter.

As described above, by providing the thermally welded portions 34, the bonded portions 38 and the bonding resins 49, the surroundings of each liquid supply passage 36 is sealed by resin and, therefore, leakage between the liquid supply passages 36 is reliably prevented. In addition, by providing the outer portion 39 continuously to the bonding resins 49, it is possible to form the supply member 30 that reliably integrates the supply member element 31, the supply needles 32 and the filters 33. Thus, the thermally welded portions 34, the bonded portions 38 and the bonding resins 49 are provided and, in addition, the outer portion 39 is integrally molded to thereby integrate the supply member element 31, the supply needles 32 and the filters 33. Hence, it is possible to integrate the supply member element 31, the supply needles 32 and the filters 33 in a state where leakage of liquid is completely prevented between the adjacent liquid supply passages. In addition, it is not necessary to reduce the area of each filter 33 for reducing the size of the head. This prevents an increase in dynamic pressure and, therefore, it is not necessary to increase a driving voltage at which the piezoelectric element 300 is driven.

Moreover, because the supply member element 31, the supply needles 32 and the filters 33 are reliably fixed by the thermally welded portions 34, the bonded portions 38 and the bonding resins 49, occurrence of a gap between the supply member element 31 and the supply needles 32 is prevented and, therefore, it is possible to prevent leakage of ink through a gap.

Note that in the present embodiment, the outer portion 39 is formed of resin that is charged through the charging hole 46 provided between the integrated two supply needles 32, and the resin is charged through the communication portion 45, which communicates with the charging hole 46, into the outer peripheries of the supply member element 31 and the supply needles 32 to thereby form the outer portion 39.

Here, a method of manufacturing the above ink jet recording head 11, particularly, the supply member 30, will be described in detail. Note that FIG. 6A to FIG. 8 are cross-sectional views that show the method of manufacturing the supply member.

Figure 6A:
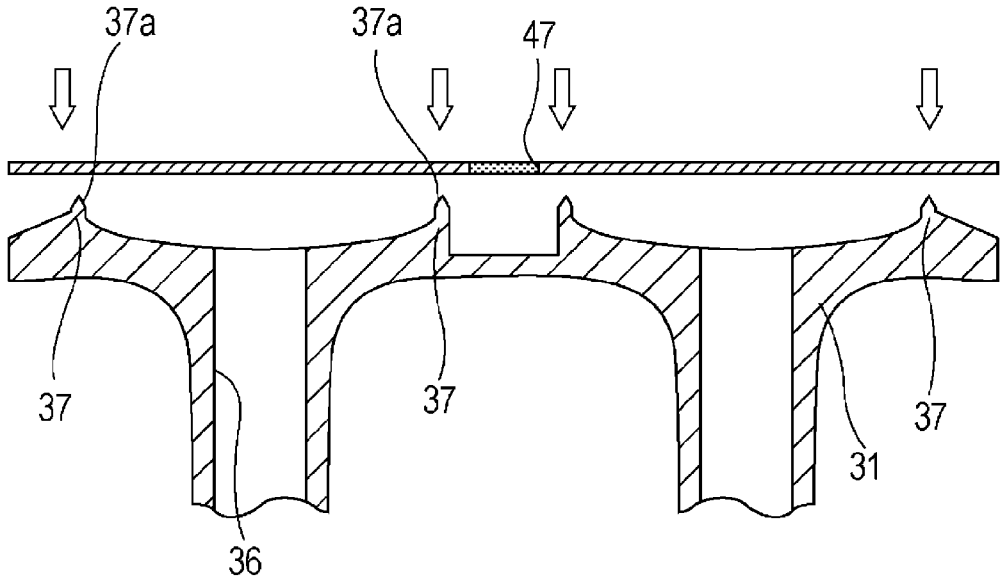
FIG. 6A and FIG. 6B are cross-sectional views that show a method of manufacturing the supply member according to the first embodiment of the invention.
Figure 6B:
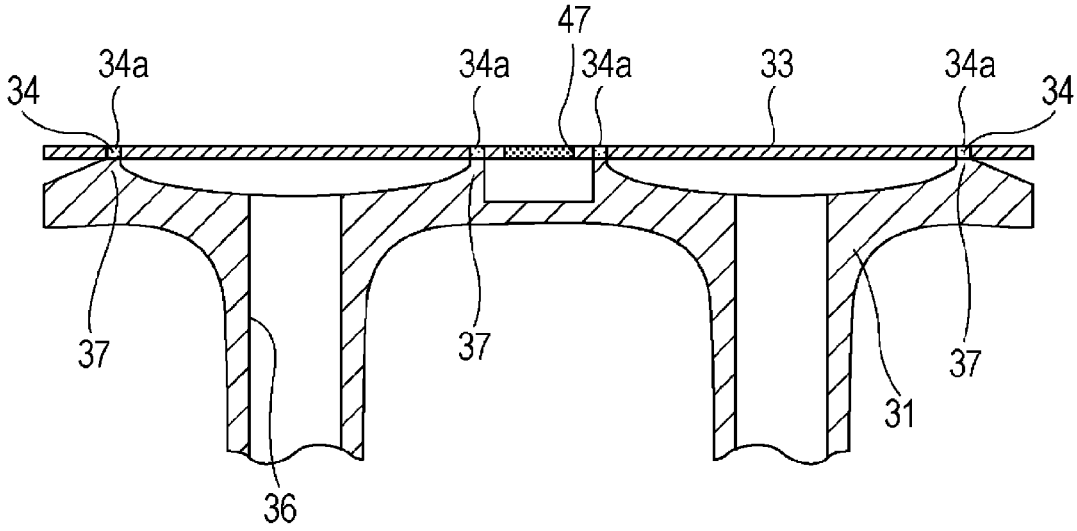

First, as shown in FIG. 6A and FIG. 6B, any one of the supply member element 31 or the supply needles 32 are integrated with the filters 33 by means of thermal welding. That is, in the present embodiment, the supply member element 31 and the filters 33 are thermally welded while applying heat, ultrasonic waves, or both through thermal welding protrusions 37*a*, which are thermal welding regions provided for the filter holding portions 37 of the supply member element 31 to thereby integrate the supply member element 31 with the filters 33. Here, the condition of thermal welding is not specifically limited; however, it is desirable that the thermal welding protrusions 37*a* are melted to soak into the opposite-side surface of the filter 33 to form surface resins 34*a* on that surface.

Figure 7A:
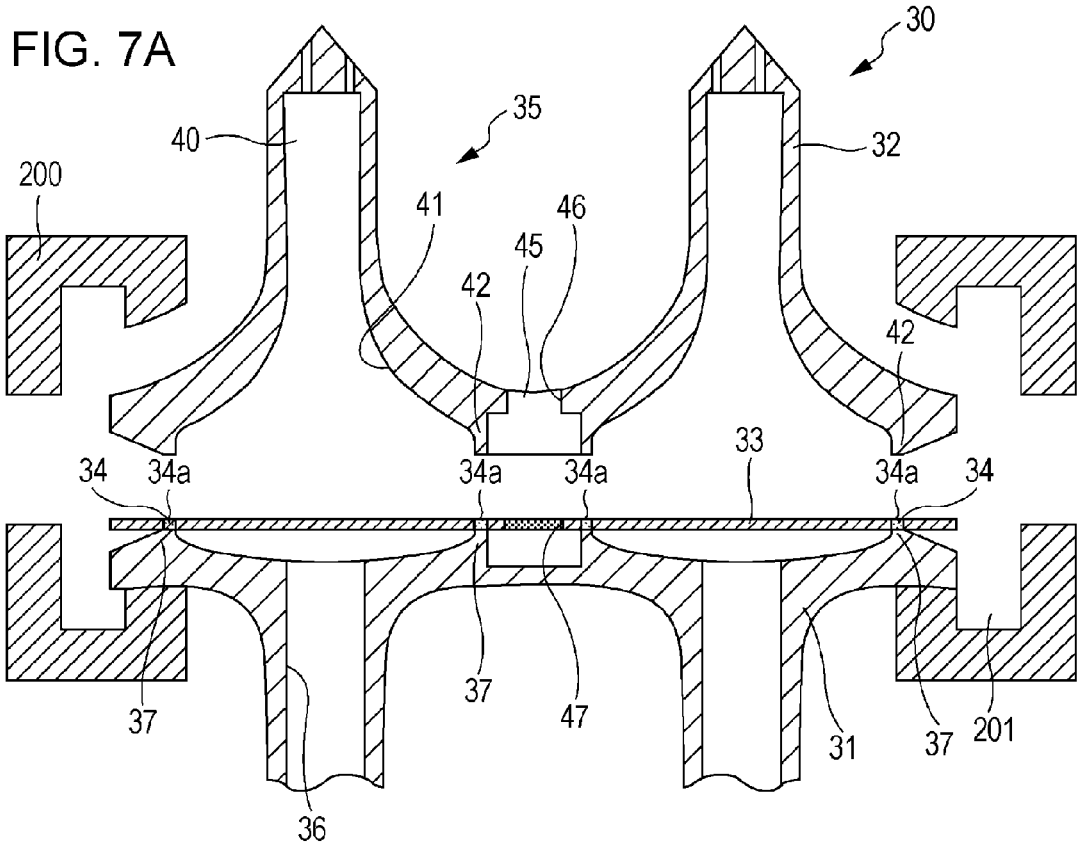
FIG. 7A and FIG. 7B are cross-sectional views that show the method of manufacturing the supply member according to the first embodiment of the invention.
Figure 7B:
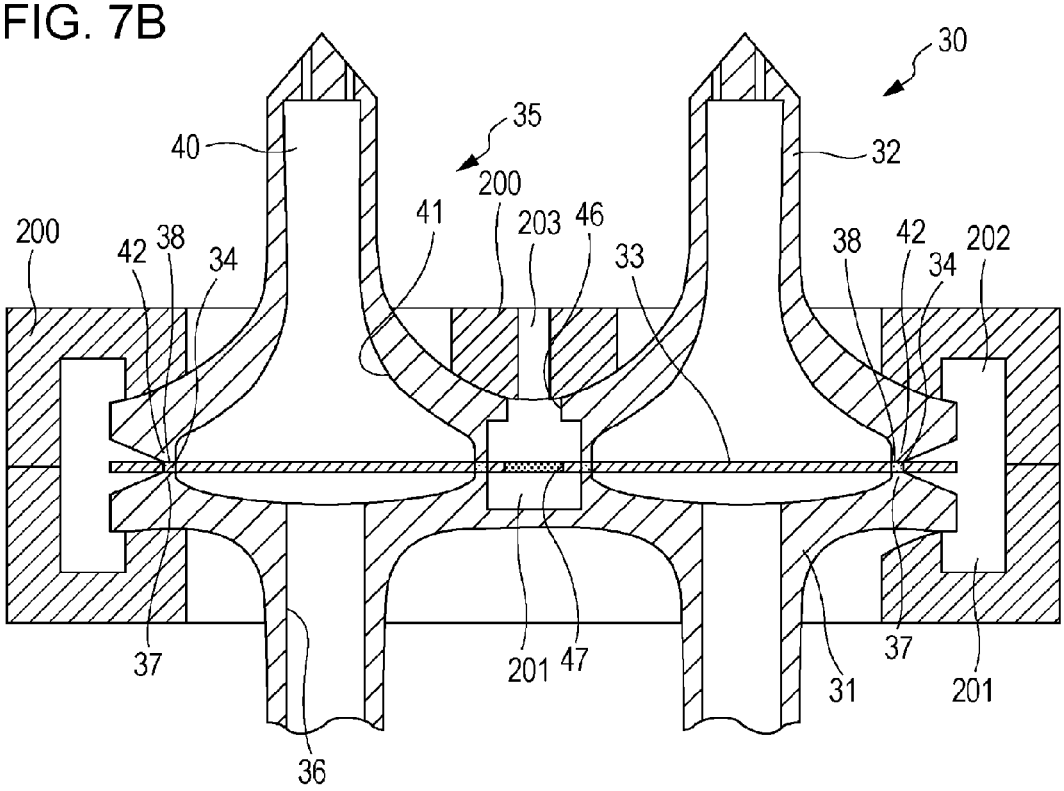

Subsequently, as shown in FIG. 7A and FIG. 7B, the supply member element 31, the filters 33 and the supply needles 32, which are integrated by the thermally welded portions 34, are placed in a die 200 so that the supply needles 32 are in contact with the thermally welded portions 34. The die 200 is, for example, formed of upper and lower divided members, and has cavities 201 and 202 for molding the communication portions 45 and the outer portion 39 and a gate 203 that communicates with the cavity 201.

Figure 8:
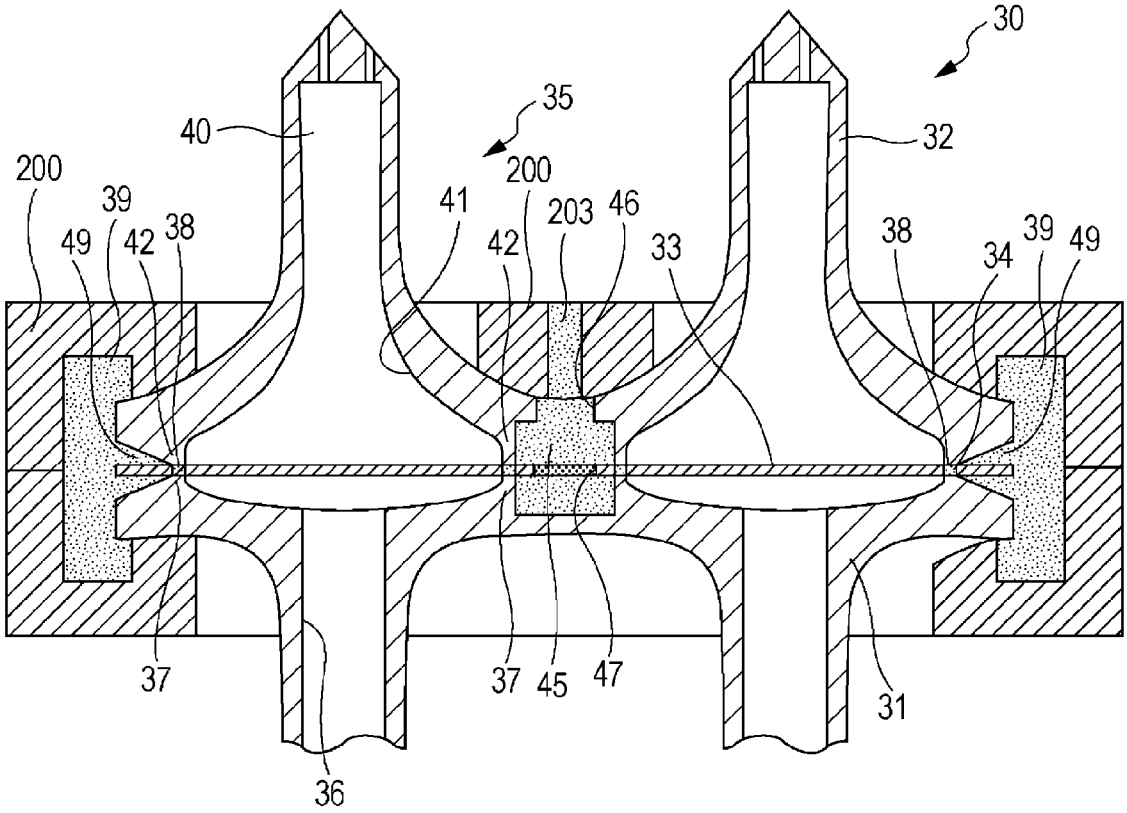
FIG. 8 is a cross-sectional view that shows the method of manufacturing the supply member according to the first embodiment of the invention.

Then, as shown in FIG. 8, resin is charged through the gate 203 to integrally mold the outer portion 39 to thereby form the supply member 30. Specifically, by charging molten resin through the gate 203 of the die 200 into the cavity 201, the molten resin flows outside the outer peripheries of the filters 33 between the supply member element 31 and the supply needles 32 into the outer regions outside the regions in which the thermally welded portions 34 are in contact with the supply needles 32. At this time, heat melts the surface resins 34*a* of the thermally welded portions 34 to thereby form the bonded portions 38 at which the filters 33 and the supply needles 32 are bonded via the thermally welded portions 34. In addition, at the same time, the outer regions are filled with the bonding resins 49, and then the thermally welded portions 34, the bonded portions 38 and the bonding resins 49 are integrated. In addition, the outer portion 39 is molded continuously to the bonding resins 49 by the resin flowing outside the supply member element 31 and the supply needles 32. Thus, the outer portion 39 is provided around the supply member element 31 and the supply needles 32 to fix the outer peripheries of the supply member element 31, the supply needles 32 and the filters 33.

Note that as described above, because each filter 33 of the present embodiment has the through-hole 47, resin easily passes through the through-hole 47 and flows to the upper and lower sides of the filter 33 within the cavity 201 of the die 200. Thus, it is possible to easily charge molten resin into the die 200.

The thus formed supply member 30 is integrated by the bonding resins 49 and the outer portion 39 in a state where the liquid supply passages 36 are individually and reliably isolated by the thermally welded portions 34 and the bonded portions 38.

Figure 9:
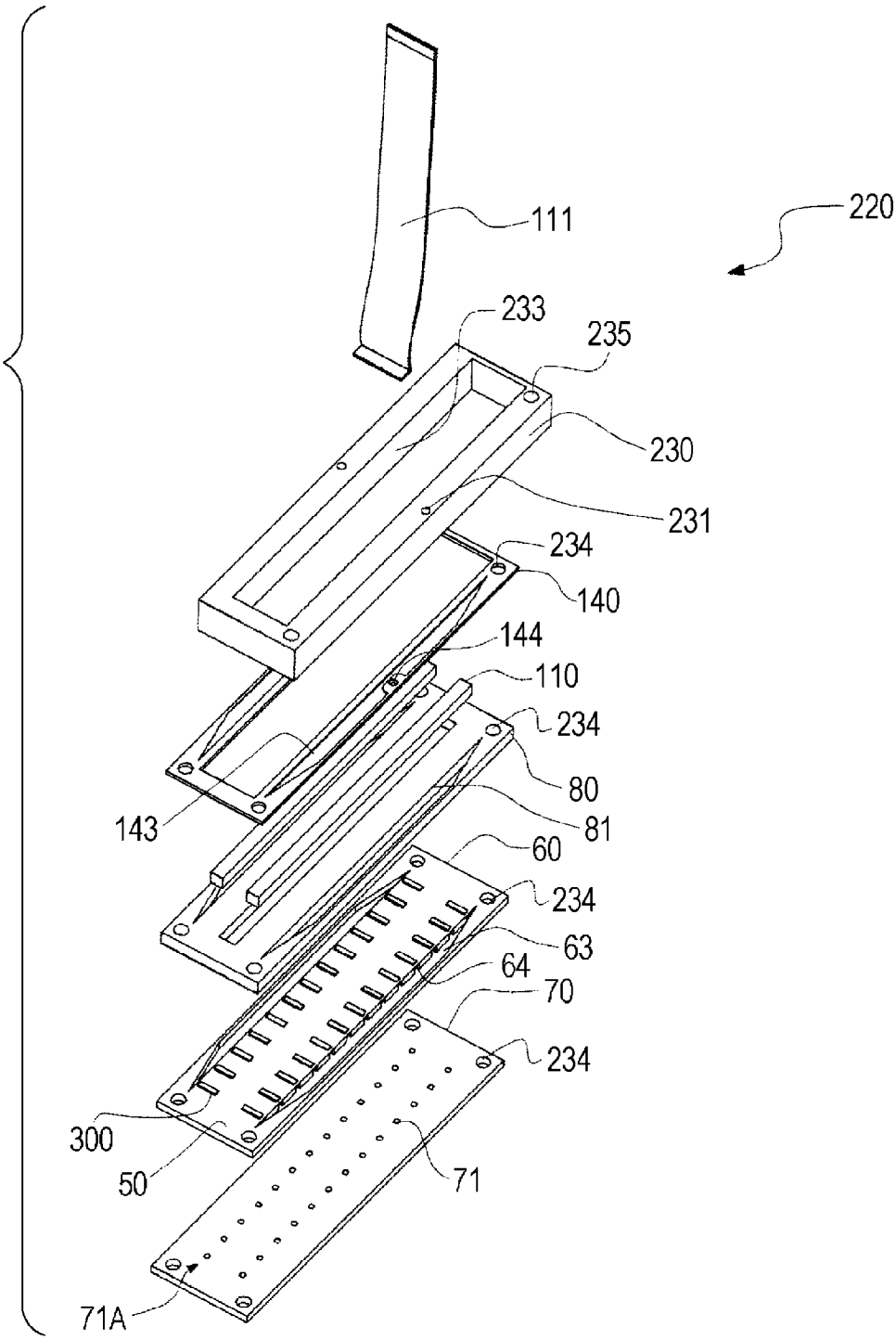
FIG. 9 is an exploded perspective view that shows a head element according to the first embodiment of the invention.
Figure 10:
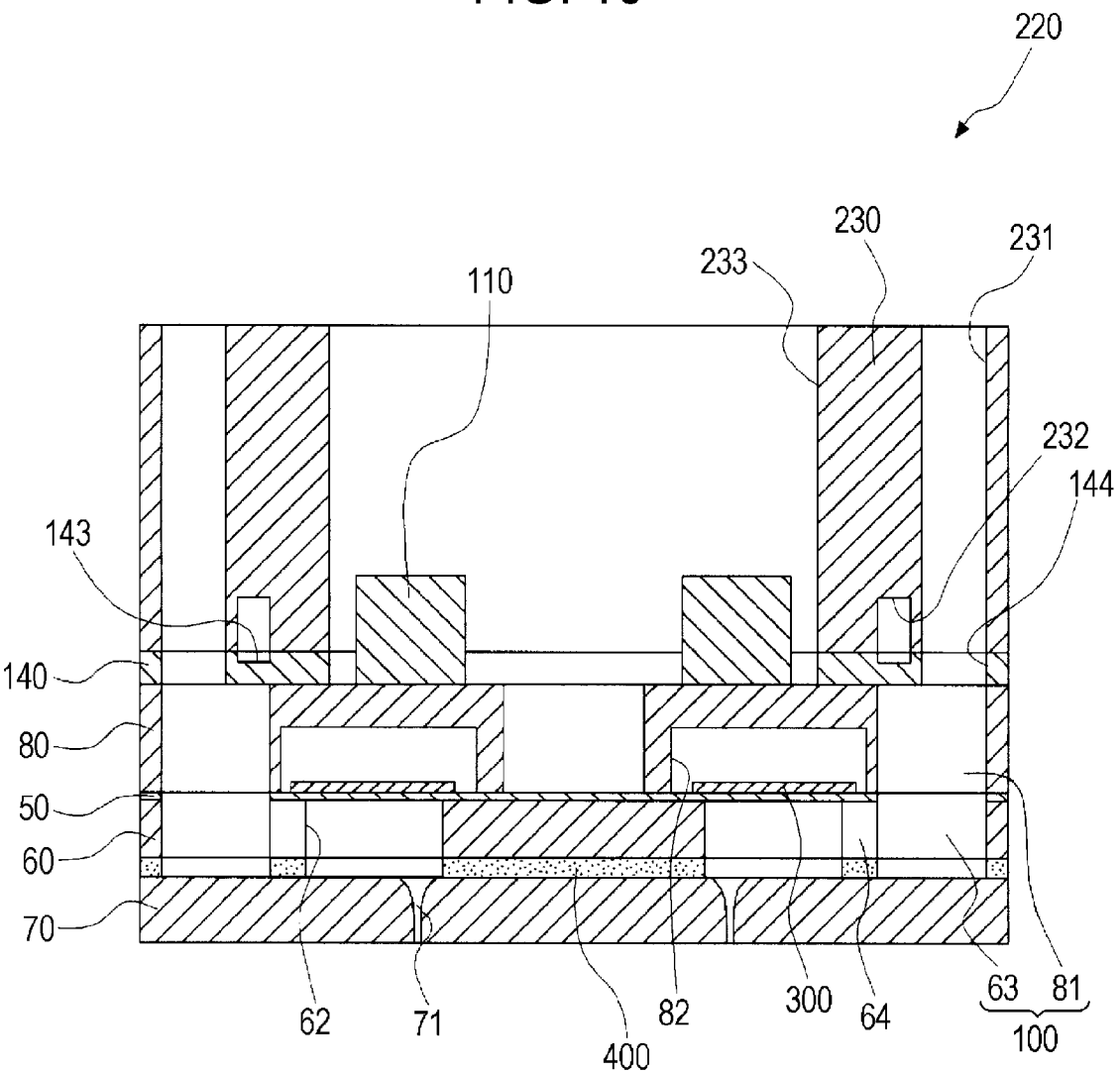
FIG. 10 is a cross-sectional view that shows the head element according to the first embodiment of the invention.

In addition, the head element 220 is provided on a side of the supply member 30, which is opposite to a side on which the supply needles 32 are provided. Here, the head element 220 will be described. Note that FIG. 9 is an exploded perspective view of the head element, and FIG. 10 is a cross-sectional view of the head element.

As shown in the drawings, in the present embodiment, a flow passage forming substrate 60 that constitutes the head element 220 is a silicon single crystal substrate, and an elastic film 50 made of silicon dioxide is formed on one end surface. The flow passage forming substrate 60 has pressure generating chambers 62, which are formed by anisotropic etching from the other end surface and defined by a plurality of partition walls. The pressure generating chambers 62 are arranged in two lines that are parallel to each other in the widthwise direction. In addition, a communication portion 63 is formed at the longitudinal outer side of each line of pressure generating chambers 62, and communicates with a reservoir portion 81, provided in a reservoir forming substrate 80, which will be described later, to constitute a reservoir 100, which is an ink chamber common to the pressure generating chambers 62. In addition, the communication portion 63 communicates with the longitudinal one end of each pressure generating chamber 62 through an ink supply passage 64. That is, in the present embodiment, the pressure generating chambers 62, the communication portions 63 and the ink supply passages 64 are provided as liquid flow passages formed in the flow passage forming substrate 60.

In addition, a nozzle plate 70, in which nozzle openings 71 are formed, is bonded by an adhesive agent 400 to an opening surface side of the flow passage forming substrate 60. Specifically, a plurality of the nozzle plates 70 are provided in correspondence with a plurality of the head elements 220, and each nozzle plate 70 has an area slightly larger than an exposed opening portion 241 of the cover head 240, which will be described later, and is fixed in a region that overlaps the cover head 240 by an adhesive agent, or the like. Note that the nozzle openings 71 of each nozzle plate 70 are formed at positions that communicate with the pressure generating chambers 62 at the opposite side with respect to the ink supply passages 64. In the present embodiment, because two parallel lines of the pressure generating chambers 62 are provided in the flow passage forming substrate 60, two parallel lines of nozzle columns 71A in which the nozzle openings 71 are arranged are provided in each head element 220. Then, in the present embodiment, a surface of the nozzle plate 70, on which the nozzle openings 71 are open, is a liquid ejecting surface. The above nozzle plate 70 is, for example, a silicon single crystal substrate or a metal substrate made of stainless steel (SUS), or the like.

On the other hand, piezoelectric elements 300 are formed on a side of the flow passage forming substrate 60, which is a side opposite to the opening surface. Each of the piezoelectric elements 300 is formed so that a lower electrode film made of metal, a piezoelectric element layer made of piezoelectric material such as lead zirconate titanate (PZT), and an upper electrode film made of metal are sequentially laminated on the elastic film 50.

The reservoir forming substrate 80 having the reservoir portions 81 that at least partially constitute the reservoir 100 is bonded onto the flow passage forming substrate 60 on which the above piezoelectric elements 300 are formed. In the present embodiment, the reservoir portions 81 each extend through the reservoir forming substrate 80 in the thickness direction and are formed in the widthwise direction of the pressure generating chambers 62. The reservoir portions 81 each communicate with the corresponding communication portion 63 of the flow passage forming substrate 60 to form the reservoir 100, which is the ink chamber common to the pressure generating chambers 62.

In addition, piezoelectric element holding portions 82 are provided in regions that face the piezoelectric elements 300 of the reservoir forming substrate 80, and have a space with a size that does not interfere with movement of the piezoelectric element 300.

Furthermore, a driving circuit 110 formed of a semiconductor integrated circuit (IC), or the like, for driving the piezoelectric elements 300 is provided on the reservoir forming substrate 80. Each of the terminals of the driving circuit 110 is connected to a lead wire that is extended from an individual electrode of each piezoelectric element 300 through a bonding wire (not shown), or the like. Then, each terminal of the driving circuit 110 is connected to the outside through an external wiring 111, such as a flexible printed circuit substrate (FPC), and receives various signals, such as a print signal, through the external wiring 111 from the outside.

In addition, a compliance substrate 140 is bonded onto the reservoir forming substrate 80. Ink introducing ports 144 for supplying ink to the reservoirs 100 are formed in regions of the compliance substrate 140, facing the reservoirs 100, so as to extend through the compliance substrate 140 in the thickness direction. In addition, the regions of the compliance substrate 140, facing the reservoirs 100, other than the ink introducing ports 144, are flexible portions 143 that are formed to be thin in the thickness direction, and the reservoirs 100 are sealed by the flexible portions 143. The flexible portions 143 give compliance to the insides of the reservoirs 100.

In addition, a head case 230 is fixed onto the compliance substrate 140.

The head case 230 has ink supply communication passages 231 that respectively communicate with the ink introducing ports 144, and that communicate with the liquid supply passages 36 of the supply member 30 to thereby supply ink from the supply member 30 to the ink introducing ports 144. Grooves 232 are formed in the head case 230 in regions that face the flexible portions 143 of the compliance substrate 140 to allow appropriate flexible deformation of the flexible portions 143. In addition, the head case 230 includes driving circuit holding portions 233 that extend through in the thickness direction in regions facing the driving circuit 110 provided on the reservoir forming substrate 80, and the external wiring 111 is inserted through the driving circuit holding portion 233 and connected to the driving circuit 110.

In addition, as shown in FIG. 2, the head elements 220, each of which is held by the supply member 30 through the head case 230, are relatively positioned and held by the box-shaped cover head 240 so as to cover the liquid ejecting surface sides of the five head elements 220. The cover head 240 includes the exposed opening portions 241 that expose the nozzle openings 71 and bonded portions 242 that define the exposed opening portions 241 and that are at least bonded to both ends of the liquid ejecting surface, on which the nozzle columns 71A of the nozzle openings 71 are arranged parallel to each other, of each head element 220.

In the present embodiment, the bonded portion 242 is formed of a frame portion 243 provided along the outer periphery of the liquid ejecting surface over the plurality of head elements 220 and beam portions 244 that extend between the adjacent head elements 220 to divide the exposed opening portions 241. The frame portion 243 and the beam portions 244 are bonded onto the liquid ejecting surfaces of the head elements 220, that is, the surfaces of the nozzle plates 70.

In addition, the cover head 240 includes a side wall portion 245 at the sides of the liquid ejecting surfaces of the head elements 220. The side wall portion 245 extends so as to bend along the outer peripheral portion of the liquid ejecting surfaces.

Thus, the cover head 240 is formed so that the bonded portion 242 is bonded to the liquid ejecting surfaces of the head elements 220, so it is possible to reduce a step between the liquid ejecting surfaces and the cover head 240. Even when wiping, vacuuming operation, or the like, for the liquid ejecting surfaces performed, it is possible to prevent ink from remaining on the liquid ejecting surfaces. In addition, because the beam portions 244 close the gap between the adjacent head elements 220, ink does not enter into the gap between the adjacent head elements 220 and, therefore, it is possible to prevent degradation and breakage of the piezoelectric elements 300 or driving circuit 110 due to ink. In addition, because the liquid ejecting surfaces of the head elements 220 and the cover head 240 are bonded by an adhesive agent without any gap, by preventing the recorded target medium S from entering into the gaps, it is possible to prevent deformation of the cover head 240 and paper jamming. Furthermore, the side wall portion 245 covers the outer periphery of the plurality of head elements 220, so it is possible to reliably prevent ink from flowing to the side surfaces of the head elements 220. In addition, because the cover head 240 includes the bonded portion 242 that is bonded to the liquid ejecting surfaces of the head elements 220, the nozzle columns 71A of the plurality of head elements 220 may be accurately positioned and then bonded to the cover head 240.

The cover head 240 may be, for example, a metal material, such as stainless steel. The cover head 240 may be formed by pressing a metal plate or may be formed by molding. In addition, the cover head 240 may be grounded by forming the cover head 240 from a conductive metal material. Note that bonding of the cover head 240 with the nozzle plates 70 is not specifically limited. For example, the bonding may use a thermosetting epoxy-based adhesive agent or an ultraviolet curing adhesive agent.

The ink jet recording head 11 of the present embodiment draws ink from the ink cartridges 13 through the liquid supply passages 36 and fills the inside from the reservoirs 100 to the nozzle openings 71 with ink through the ink supply communication passages 231 and the ink introducing ports 144. After that, in accordance with recording signals from the driving circuit 110, the ink jet recording head 11 applies voltages to the piezoelectric elements 300 corresponding to the pressure generating chambers 62 to thereby flexibly deform the elastic films 50 and the piezoelectric elements 300. Thus, pressures in the pressure generating chambers 62 increase to discharge ink droplets from the nozzle openings 71.

Second Embodiment

Figure 11:
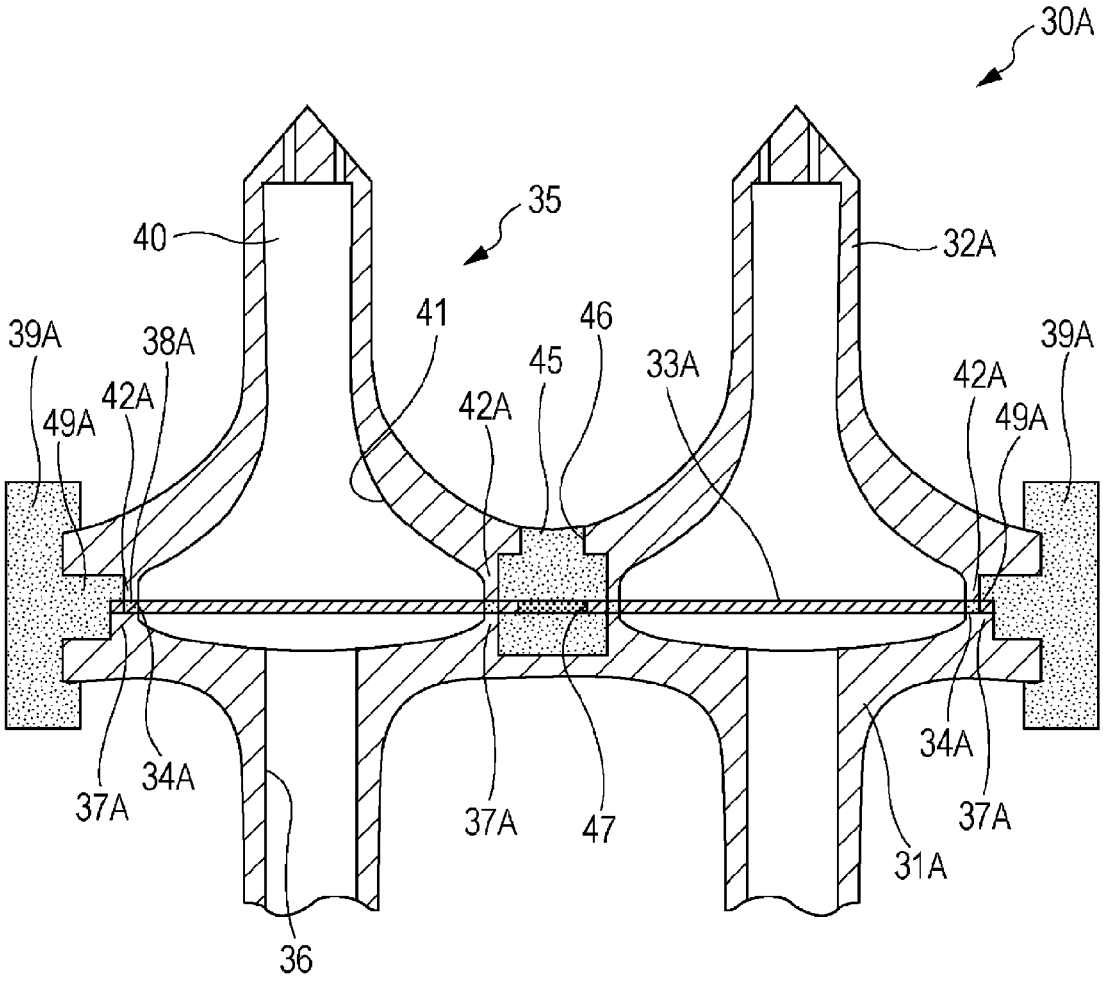
FIG. 11 is a cross-sectional view that shows another example of a supply member according to a second embodiment of the invention.

FIG. 11 is a cross-sectional view of a supply member according to a second embodiment. The supply member 30A of the present embodiment is similar to that of the first embodiment except that the outer portion is formed to extend continuously to the upper surfaces of the thermally welded portions. Like reference numerals denote like components to those of the first embodiment, and the description thereof will not be repeated.

As shown in the drawing, the supply needles 32A contact only in regions inside the thermally welded portions 34A of the filters 33A and supply member elements 31A to form the bonded portions 38A, the bonding resins 49A of the outer portion 39A are formed to enter into regions outside the upper surfaces of the thermally welded portions 34A, and then the thermally welded portions 34A, the bonded portions 38A and the bonding resins 49A are integrated. That is, the filter holding portions 42A of the supply needles 32A are formed to be smaller than the filter holding portions 37A of the supply member elements 31A, and resin that forms the outer portion 39A is charged onto the upper surfaces of the thermally welded portions 34A, which are located outside the filter holding portions 42A. Thus, the bonding resins 49*a* are formed continuously so as to overlap the thermally welded portions 34A, and the thermally welded portions 34A and the bonded portions 38A are further reliably integrated with the bonding resins 49A. Thus, the thermally welded portions 34A, the bonded portions 38A and the bonding resins 49A reliably isolate the liquid supply passages 36 to thereby prevent mixing of liquid. In addition, it is further reliably reinforced by the outer portion 39A and, therefore, isolation of the flow passages is further reliably achieved. Note that each filter 33A may employ the one larger than that shown in the drawing, and the outer portion 39A may be provided on both sides of the outer peripheral portion of each filter 33A.

Alternative Embodiment

The embodiments of the invention are described above; however, the basic configuration of the aspects of the invention is not limited to the above described embodiments.

For example, the configuration of the first supply member and second supply member are not limited to the configuration of the above described embodiments. In addition, in the above described embodiments, the first supply member employs the supply member element, and the second supply member employs the supply needle. Instead, they may be interchanged. Furthermore, the entire supply member element 31 connected to the head element 220 is employed as the first supply member; instead, the supply member element 31 may be divided into the filter 33 side and the head element 220 side, the filter 33 side component may be employed as the first supply member and integrated with the filter 33 and the supply needles 32. Note that in this case, the head element 220 side supply member element is assembled to the integrated component to form the supply member 30.

Figure 12:
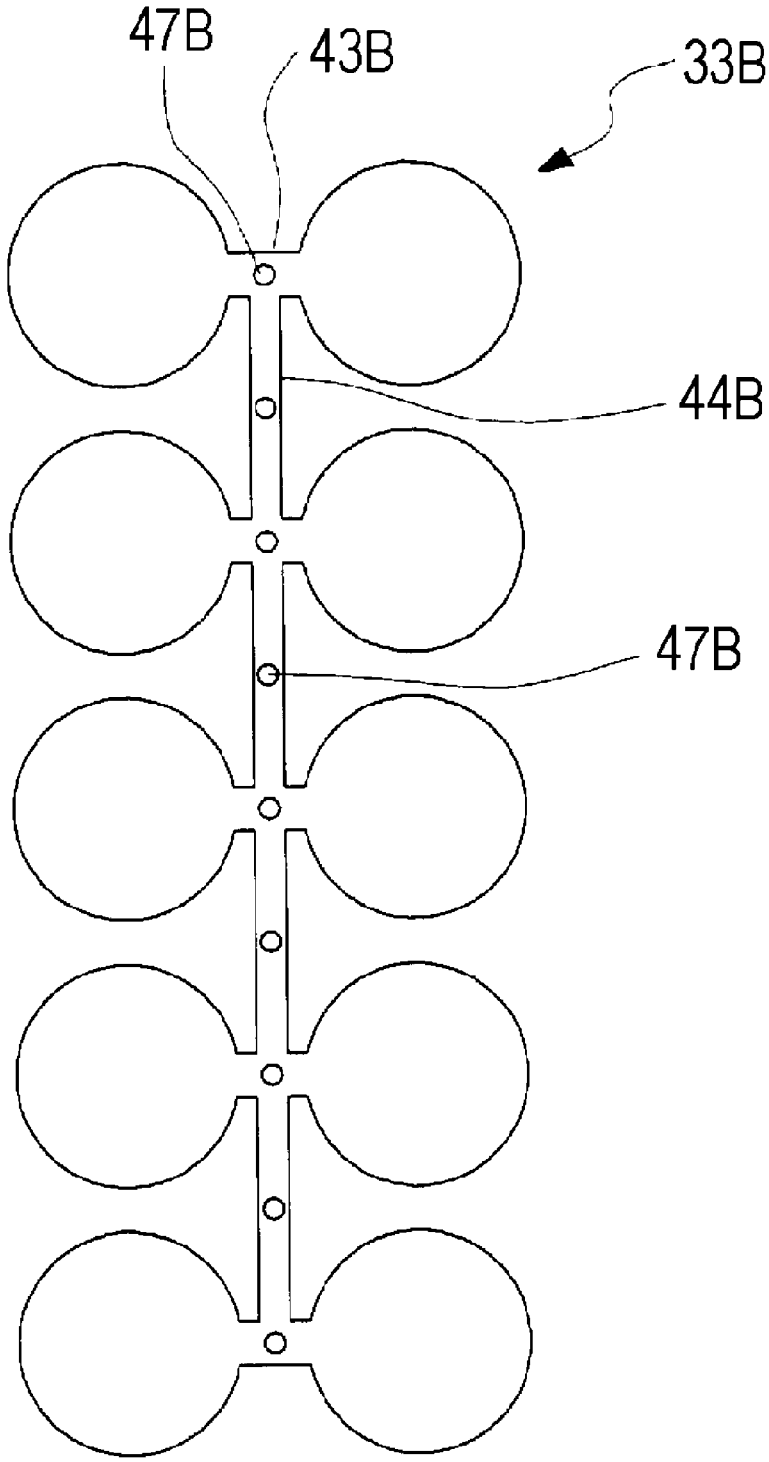
FIG. 12 is a cross-sectional view that shows another example of a filter according to an alternative embodiment of the invention.

In addition, in the above described embodiments, one member that integrates the two supply needles 32 is provided and then the plurality of supply needles 32 and the supply member element 31 are integrated by the outer portion 39; however, it is not limited. For example, it is applicable that the supply member element 31 and the supply needles 32 are provided independently of each other and then the outer portion 39 is provided respectively for the supply member element 31 and the supply needles 32. Alternatively, it is also applicable that, as described above, the outer portion 39 is formed to seal the ten liquid supply passages 36 and integrated at the same time. In this case, the filters 33 may employ quintuple pairs of above described filters or may employ filters that seal ten liquid supply passages 36 and are connected. FIG. 12 shows an example of a decuple filter. The filter 33B connects five pairs of filters corresponding to the above described two liquid supply passages 36 connected by a connecting portion 43B using connecting portions 44B. In addition, in order to easily charge resin that forms the outer portion, through-holes 47B are formed in the connecting portions 43B and 44B. Note that the connecting portions 43B and 44B are formed to be a strip shape in order to easily form the communication portions and the outer portion. Of course, the connecting portions 43B and 44B need not be in a strip shape, and the through-holes 47B need not be formed in the connecting portions 43B and 44B.

Furthermore, in the above described embodiments, the ink cartridges 13, which are the liquid reservoir portions, are detachably provided for the supply member 30; however, it is not specifically limited. Instead, for example, an ink tank, or the like, which serves as a liquid reservoir portion, may be provided at a position other than the recording head 11, and then the liquid reservoir portion may be connected to the recording head 11 through a supply pipe, such as a tube. That is, in the above first embodiment, the needle-like supply needle 32 is exemplified as a supply element; however, the supply element is not limited to a needle-like supply element.

In addition, in the above described embodiments, the configuration that one head element 220 is provided for the plurality of liquid supply passages 36 is exemplified. Instead, a plurality of head elements may be provided for each ink color. In this case, it may be configured so that each liquid supply passage 36 communicates with a corresponding one of the head elements, that is, each liquid supply passage 36 communicates with nozzle openings provided for each head element and arranged parallel to one another column by column. Of course, the liquid supply passage 36 need not communicate with nozzle openings column by column; one liquid supply passage 36 may communicate with a plurality of nozzle columns or one nozzle column may be divided into two groups and then the liquid supply passages 36 may respectively communicate with the two groups. That is, it is only necessary that the liquid supply passage 36 communicates with a nozzle opening group formed of a plurality of nozzle openings.

Furthermore, in the above described embodiments, the aspects of the invention are described using an example of the ink jet recording head 11 that discharges ink droplets; however, the aspects of the invention widely encompass general liquid ejecting heads. The liquid ejecting head may be, for example, a recording head used in an image recording apparatus, such as a printer, a color material ejecting head used for manufacturing a color filter, such as a liquid crystal display, an electrode material ejecting head used for forming an electrode of an organic EL display, an FED (field emission display), or the like, a bio-organic material ejecting head used for manufacturing a bio-chip, or the like.

The entire disclosure of Japanese Patent Application No. 2008-040623, filed Feb. 21, 2008 is incorporated by reference herein.

What is claimed is:

1. A liquid ejecting head having an nozzle opening for ejecting liquid supplied from a liquid reservoir unit, which stores the liquid, through a liquid supply passage, comprising:

a first supply member and a second supply member, each of which has the liquid supply passage formed therein;

a filter that is held between the first supply member and the second supply member in correspondence with the liquid supply passage;

a thermally welded portion that is welded to the filter so that the first supply member melts and soaks into the filter in a region that surrounds the liquid supply passage;

a bonded portion at which the second supply member is bonded to the filter by the thermally welded portion, wherein the bonded portion is adjacent to and touching the thermally welded portion; and a bonding resin that is formed by being poured into an outer region between the first supply member and the second supply member and outside the thermally welded portion and bonded portion with respect to the liquid supply passage.

2. The liquid ejecting head according to claim 1, wherein the bonding resin is formed in a region outside the bonded portion and facing the thermally welded portion.

3. The liquid ejecting head according to claim 1, wherein the thermally welded portion is present all around a region of the filter, which surrounds the liquid supply passage, wherein the liquid ejecting head further comprises an outer portion provided continuously to the bonding resin in the outer region all around the first supply member and the second supply member, and wherein the first supply member and the second supply member are additionally bonded by the outer portion.

4. The liquid ejecting head according to claim 1, wherein the thermally welded portion, the bonded portion and the bonding resin are integrated, and wherein the first supply member and the second supply member are bonded through the integrated thermally welded portion, bonded portion and bonding resin.

5. The liquid ejecting head according to claim 1, wherein the thermally welded portion forms a wall surface of the liquid supply passage.

6. A liquid ejecting apparatus comprising the liquid ejecting head according to claim 1.

* * * * *